US007294015B2

(12) United States Patent
Fujii et al.

(10) Patent No.: US 7,294,015 B2
(45) Date of Patent: Nov. 13, 2007

(54) CONNECTOR AND A METHOD FOR CONTROLLING THE ASSEMBLY THEREOF

(75) Inventors: Masayasu Fujii, Yokkaichi (JP); Toshikazu Sakurai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/644,796

(22) Filed: Dec. 22, 2006

(65) Prior Publication Data

US 2007/0149041 A1 Jun. 28, 2007

(30) Foreign Application Priority Data

Dec. 26, 2005 (JP) ..... 2005-372234

(51) Int. Cl.
*H01R 3/00* (2006.01)

(52) U.S. Cl. ..... 439/489

(58) Field of Classification Search ..... 439/489, 439/188, 157

See application file for complete search history.

(56) References Cited

U.S. PATENT DOCUMENTS 5,128,830 A * 7/1992 Deluca et al. ..... 361/695
5,277,608 A 1/1994 Oda
5,647,754 A 7/1997 Kohno
5,775,939 A 7/1998 Brown
5,863,216 A 1/1999 Tsuji et al.
6,257,922 B1 * 7/2001 Shinozaki ..... 439/489
6,332,804 B2 * 12/2001 Kurimoto et al. ..... 439/489
6,371,796 B2 * 4/2002 Fukuda ..... 439/489
2007/0072482 A1 * 3/2007 Fujii et al. ..... 439/489

FOREIGN PATENT DOCUMENTS

JP 2003-086301 3/2003

* cited by examiner

*Primary Examiner*—Phuong Dinh
(74) *Attorney, Agent, or Firm*—Gerald E. Hespos; Anthony J. Casella

(57) ABSTRACT

A connector has first and second housings (10, 30) that are connectable with each other. The second housing (30) has second terminal fittings (32), second detecting terminals (39) and short canceling members (37). The first housing (10) has shorting terminals (12) for shorting pairs of the first terminal fittings, a resilient arm (18) that deforms as the housings (10, 30) are connected, and first detecting terminals (11) that deform as the resilient arm (18) is deformed to touch the second detecting terminals (39) for detecting the connected state. The resilient arm (18) is held deformed and the first detecting terminals (11) are held in contact with the second detecting terminals (39) until a connecting operation is completed. The resilient arm (18) resiliently restores to separate the first detecting terminals (11) from the second detecting terminals (32) when the connection is completed.

10 Claims, 13 Drawing Sheets

CONNECTOR AND A METHOD FOR CONTROLLING THE ASSEMBLY THEREOF

BACKGROUND OF THE INVENTION

1. Field of the Invention

The invention relates to a connector and to a method of controlling the assembly thereof.

2. Description of the Related Art

Japanese Unexamined Patent Publication No. 2003-86301 discloses a connector provided with first and second housings. A lever is supported rotatably on the first housing, and has a cam groove. A cam pin is formed on the second housing and is engageable with the cam groove by lightly fitting the two housings together while the lever is at an initial position. The lever then is rotated to a connection position. As a result, a cam action between the cam groove and the cam pin pulls the two housings towards each other and into a completely connected state. The lever includes a detector that is displaceable from a standby position to a detecting position. The detector can be displaced from the standby position to the detecting position when the lever is at the proper connection position. However, the detector cannot be displaced to the detecting position when the lever is left at a partial connection position immediately before arriving the proper connection position.

The connected state of the two housings is detected mechanically based on the rotational position of the lever. However, there has also been a demand for electrically detecting the connected state of the two housings, and such a demand has needed to be met.

The invention was developed in view of the above situation and an object thereof is to reliably electrically detect a connected state of two housings.

SUMMARY OF THE INVENTION

The invention relates to a connector with first and second housings that are connectable with each other. Second terminal fittings, at least one second detecting terminal and a short canceling member are arranged in the second housing. First terminal fittings are arranged in the first housing and are disposed to contact the second terminal fittings when the housings are connected. At least one shorting terminal is provided in the first housing for contacting and shorting at least two of the first terminal fittings. A resilient arm is provided in the first housing and is deformable as the first and second housings are connected. At least one resiliently deformable first detecting terminal is provided in the first housing and is deformable as the resilient arm is deformed. The first detecting terminal is disposed to directly or indirectly touch the second detecting terminal to detect a connected state of the first and second housings. The resilient arm is held in a deformed state and the first detecting terminal is held in contact with the second detecting terminal until a connecting operation is completed. The short canceling member holds the shorting terminal separated from the first terminal fitting as the connecting operation progresses. The resilient arm restores and the first and second detecting terminals are separated when the connecting operation is completed. Thus, the connected state of the housings can be detected electrically.

The shorting terminal shorts adjacent first terminal fittings up to a specified timing during the connecting operation is arranged in the first housing. Thus, at least one of the first detecting terminal and the shorting terminal is in an electrically connected state for all conditions except the completely connected state of the two housings. Additionally, both the first detecting terminal and the shorting terminal are in an electrically unconnected state in the completely connected state of the two housings. In other words, these circuits are opened as the connecting operation is completed. An arrangement that closed these circuits as the connecting operation is completed could be affected by noise mixed in the electrically unconnected state during the connecting operation and could lead to an erroneously judgment that the connecting operation has been completed. In this respect, the electrically connected state is already set in the method for opening the circuits as the connecting operation is completed. Thus, the connecting operation is surely in process and can be monitored effectively. Accordingly, there is no likelihood of erroneously judging the completion of the connecting operation. In addition, even if noise is mixed in or present after the completion of the connecting operation, such noise mixture or noise would be detected as an incompletely connected state and an abnormal state can be dealt with. Accordingly, overall operability of the connector is improved.

The short canceling member preferably thrusts itself between the shorting terminal and the first terminal fittings as the connecting operation progresses.

The shorting terminal preferably is separated from the first terminal fittings after the first and second terminal fittings contact each other. Accordingly, the first terminal fittings are connected electrically with the second terminal fittings when they are freed from their shorted state. Thus, the safety of the operation can be assured.

A movable member preferably is provided on one of the housings and is operable to connect and separate the housings or to assist the connection and separation thereof by means of a cam action.

The operable member formed with at least one cam means preferably is assembled movably into the first housing at a side of the resilient arm substantially opposite to the first detecting terminal. A mating cam means that can cooperate with the cam means is formed in the second housing.

At least one pressing portion is formed at a portion of the movable member substantially facing the resilient arm. The pressing portion is configured to press the resilient arm and to hold the resilient arm deformed during the operation of the movable member. However, the pressing portion stops pressing the resilient arm so that the resilient arm can restore when the connecting operation is completed.

The movable member preferably is a lever with a cam groove and is assembled rotatably to the first housing at a side of the resilient arm opposite the first detecting terminal. A cam pin is formed in the second housing and is movable along the cam groove. A pressing portion is formed at a portion of the lever facing the resilient arm. The pressing portion presses the resilient arm to hold the resilient arm deformed during rotation of the lever, but stops pressing the resilient arm so that the resilient arm can restore when the connecting operation is completed. The cam pin is introduced into the cam groove by lightly fitting the two housings together. The cam pin moves along the cam groove as the lever is rotated and urges the housings together. The pressing portion on the lever presses and deforms the resilient arm during this time, and the deformed resilient arm holds the first detecting terminal in contact with the second detecting terminal. The resilient arm is freed from the pressed state when the lever is rotated sufficiently to complete the connecting operation. Therefore, the resilient arm resiliently restores and permits the first detecting terminal to separate from the second detecting terminal.

The resilient arm preferably is cantilevered rearwardly along part of an inner wall of the detecting terminal accommodating portion. A pressable portion is formed at a free end of the resilient arm and can be engaged by the pressing portion of the lever. A contact projection is formed at a longitudinal intermediate position of the resilient arm for directly or indirectly contacting the first detecting terminal. Thus, the resilient arm uses a lever principle to deform the first detecting terminal, and an operation force exerted on the pressable portion is small.

The invention relates to a method of controlling a connection of first and second housings. The method includes contacting a shorting terminal with at least two first terminal fittings in the first housing prior to connecting the housings; moving the first and second housings towards a connected condition; contacting a first detecting terminal in the first housing with a second detecting terminal in the second housing during a connecting operation; separating the shorting terminal from the first terminals when the first terminals contact second terminals in the second housing; and separating the first detecting terminal from the second detecting terminal when the connecting operation is complete to detect the connected state of the first and second housings.

Accordingly, the first detecting terminal of the first housing is held in contact with the second detecting terminal of the second housing until the connecting operation is substantially completed, and the first detecting terminal is separated from the second detecting terminal when the connection is completed. Thus, the connected state of the housings is detected electrically.

The shorting terminal preferably is separated from the first terminal fittings by thrusting a short canceling member between the shorting terminal and the first terminal fittings as the connecting operation progresses.

These and other features and advantages of the invention will become more apparent upon reading the following detailed description and accompanying drawings.

DETAILED DESCRIPTION OF THE PREFERRED EMBODIMENTS

A connector according to the invention is described with reference to FIGS. 1 to 13. The connector is intended for use with an airbag and has first and second housings 10 and 30 that are connectable with each other. In the following description, ends of the first and second housings 10, 30 to be connected are referred to as the front ends concerning forward and backward directions FBD.

Figure 7:
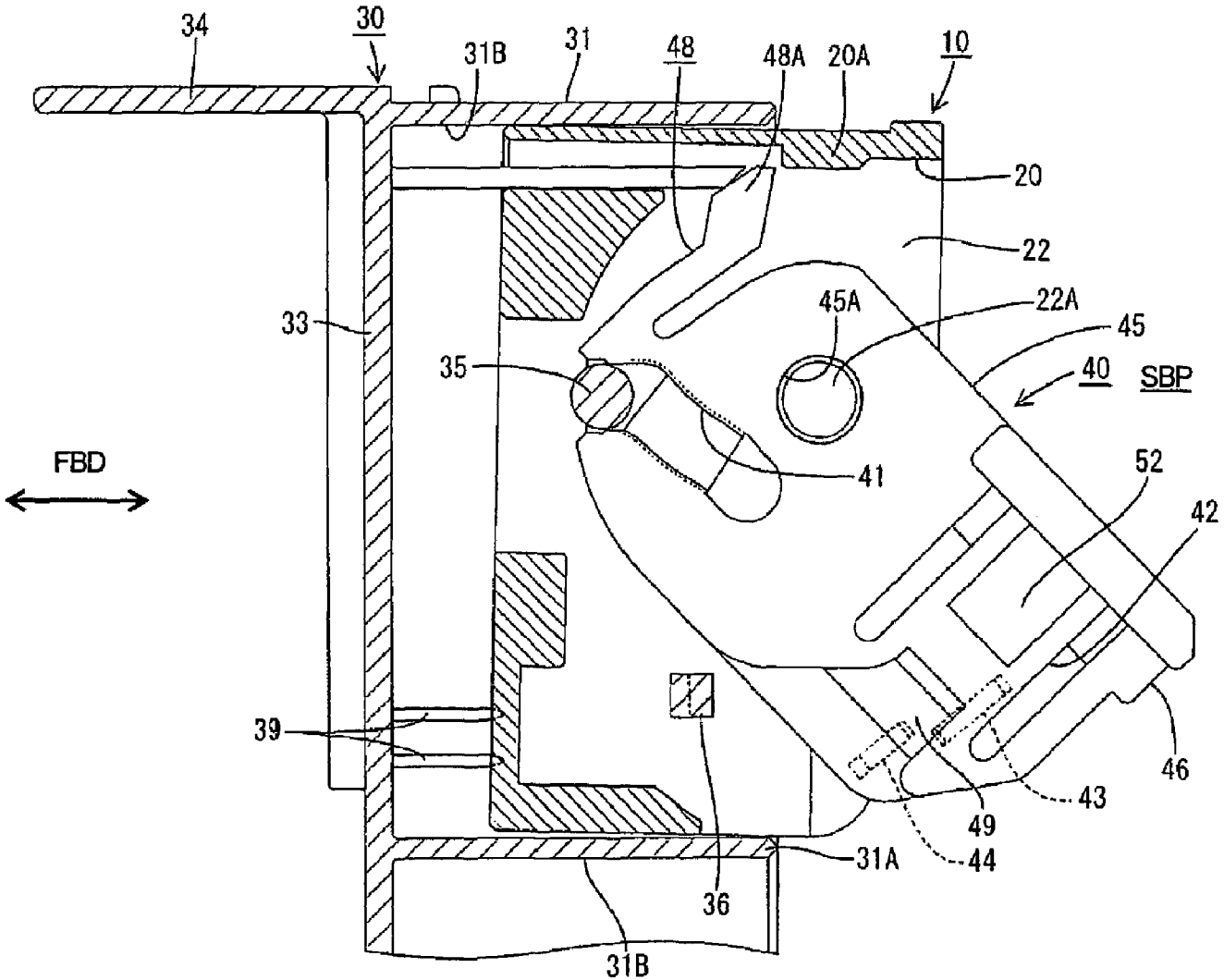
FIG. 7 is a plan view in section showing the state of FIG. 1.
Figure 8:
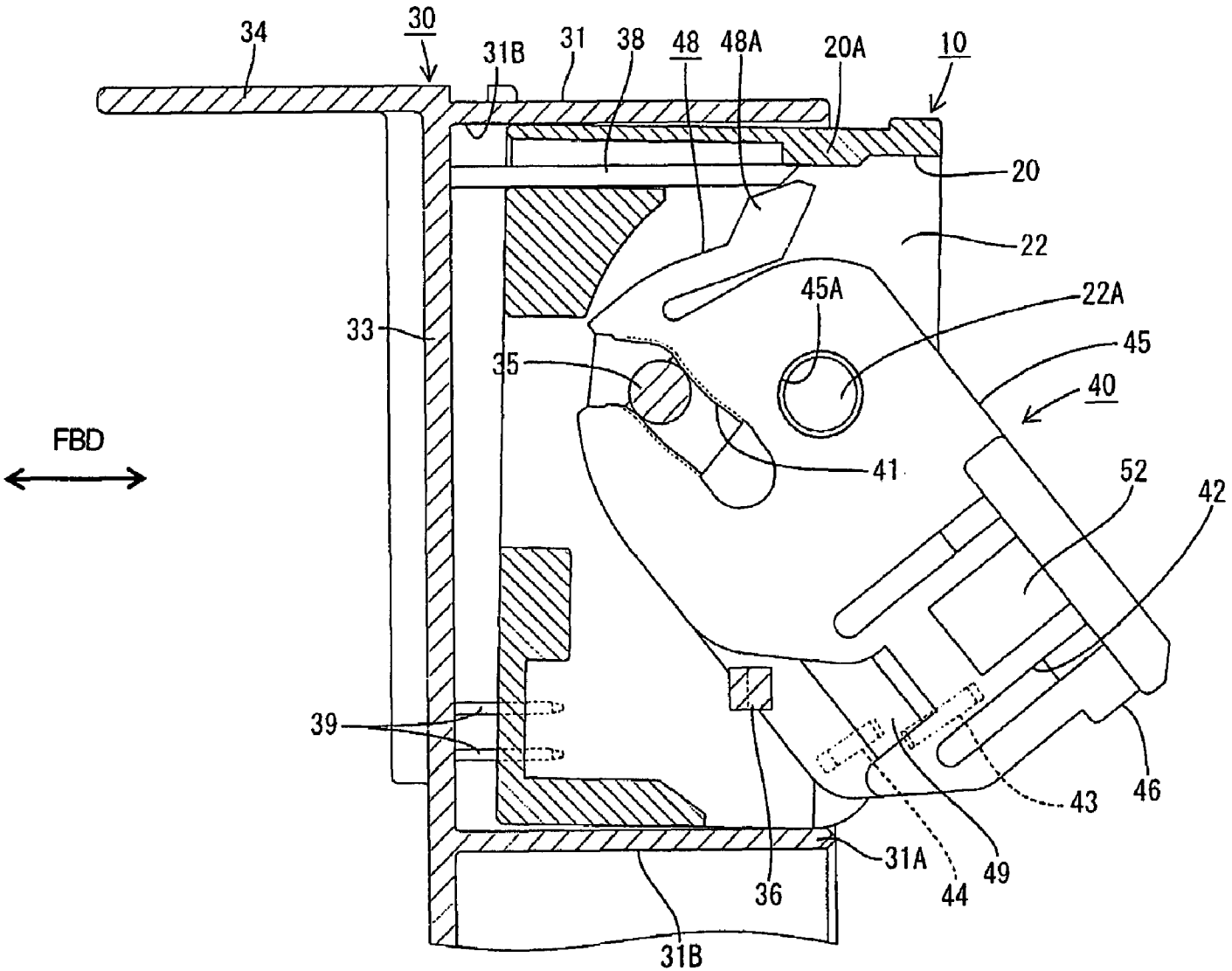
FIG. 8 is a plan view in section showing the state of FIG. 2.

The second housing 30 is made e.g. of a synthetic resin and has a receptacle 31 having an open front, as shown in FIG. 7. The receptacle 31 is rectangle when viewed from the front, and a partition wall 31A extends vertically in an intermediate position of the receptacle 31. The partition wall 31A divides the interior of the receptacle 31 into left and right fitting recesses 31B for receiving the first housings 10. Only the right fitting recess 31B when viewed from the front is shown in FIGS. 7 to 12 and the construction of only the right fitting recess 31B is described below. However, the fitting recesses have substantially the same configuration.

Second terminal fittings 32 in the form of tabs are arranged transversely at upper, middle and lower stages in each fitting recess 31B. Two second detecting terminals 39 are arranged transversely substantially side by side at a side of the second terminal fittings 32 at the upper stage near the partition wall 31A. The second detecting terminals 39 have substantially the same shape and substantially the same projecting height as the second terminal fittings 32. The second detecting terminals 39 can connect electrically with first detecting terminals 11 of the first housing 10 to close a connection detecting circuit for detecting the connected state of the two housings 10, 30.

A part of each of the second terminal fittings 32 and the second detecting terminals 39 projects back through a back wall 33 of the fitting recess 31B and is bent down substantially at right angle at an intermediate position. Bottom ends of the second terminal fitting 32 and the second detecting terminals 39 are connected electrically with a detecting device, such as a conductor path of an unillustrated printed circuit board thereof. Protection walls 34 project back from the rear ends of the left and right sides of the receptacle 31, and exposed parts of the respective second terminal fittings 32 and second detecting terminals 39 are protected laterally by the protection walls 34.

A short canceling member 37 projects forward from the back wall 33 of the fitting recess 31B above each pair of second terminal fittings 32 transversely adjacent to each other at the upper and middle stages. The short canceling members 37 enter a communication space S of the first housing 10 between shorting terminals 12 and first terminal fittings 13.

A cam pin 35 projects down and in at a relatively transversely outward position of the ceiling surface of the fitting recess 31B. Further, a disengaging projection 38 projects down and in at a position on the ceiling of the fitting recess 31B near a side surface of the fitting recess 31B substantially opposite to the partition wall 31A. The disengaging projection 38 is in the form of a plate that extends in forward and backward directions FBD.

A lock 36 projects down and in at a position on the ceiling of the fitting recess 3B near the partition wall 31A. The front of the lock 36 has an upright surface that extends down and in from the ceiling of the fitting recess 31B to an intermediate position and a guiding surface 36A that slopes down and back from this intermediate position. A substantially horizontal surface extends back from the rear end of the guiding surface 36A, and a locking surface 36B extends substantially upright from the rear end of the horizontal surface towards the ceiling of the fitting recess 31B.

The connector includes a substantially U-shaped lever 40 made e.g. of a synthetic resin. The lever 40 includes a cam plate 45, a substantially plate-shaped posture correcting arm 47 opposed to the cam plate 45, and an operable portion 46 that couples ends of the cam plate 45 and the arm 47. The lever 40 is accommodated in an accommodating space 20 of the first housing 10, and is rotatable between a standby position SBP (shown in FIG. 7) at the start of connecting the two housings 10, 30 and a connection ending position CEP (shown in FIG. 12) where the two housings 10, 30 are connected completely. The following description of the lever 40 is based on a state where the lever 40 is at the connection ending position CEP shown in FIG. 12.

A cam groove 41 is formed on the upper surface of the cam plate 45 and is engageable with the cam pin 35 of the second housing 30. The cam groove 41 is formed by recessing the outer surface of the cam plate 45 and has an entrance at an edge (upper left side in FIG. 12) of the outer periphery of the cam plate 45 substantially opposite to the operable portion 46. The cam groove 41 then extends substantially towards the center of the cam plate 45. A substantially round bearing hole 45A is formed near the back of the cam groove 41. A bearing portion 22A of a lever mounting surface 22 is fit into the bearing hole 45A to rotatably support the cam plate 45. Thus, the cam pin 35 moves along the cam groove 41 and displays a cam action to connect and separate the two housings 10, 30 with and from each other as the lever 40 is rotated.

A resiliently deformable temporary-holding piece 48 projects back from a position near the entrance of the cam groove 41 and functions to hold the lever 40 temporarily at. the standby position SBP. A hook 48A projects obliquely out towards the back from the rear end of the temporary-holding piece 48. A deformation space is defined between the temporary-holding piece 48 and the outer peripheral edge of the cam plate 45, and the temporary-holding piece 48 is resiliently deformable with the entrance side of the cam groove 41 as a base end to move the hook 48A. As a result, the hook 48A engages the front end of a receiving portion 20A projecting from an inner surface of the accommodating space 20 when the lever 40 is at the standby position SBP so that the temporary-holding piece 48 prevents rotation of the lever 40 towards the connection ending position CEP. The disengaging projection 38 of the second housing 30 contacts the hook 48A from the front and deforms the temporary-holding piece 48 in to permit rotation of the lever 40. The hook 48A is in an escaping space behind the disengaging projection 38 and the receiving portion 20A when the lever 40 is at the connection ending position CEP and the temporary-holding piece 48 is restored resiliently.

The locking piece 42 is arranged at a side of the operable portion 46 in the cam plate 45 and is engageable with the lock projection 36 of the second housing 30. The locking piece 42 is a cantilevered rearward between two slits in the cam plate 45, and is resiliently deformable up and down in directions substantially parallel to the thickness direction TD of the cam plate 45 with the front end thereof as a base.

Figure 1:
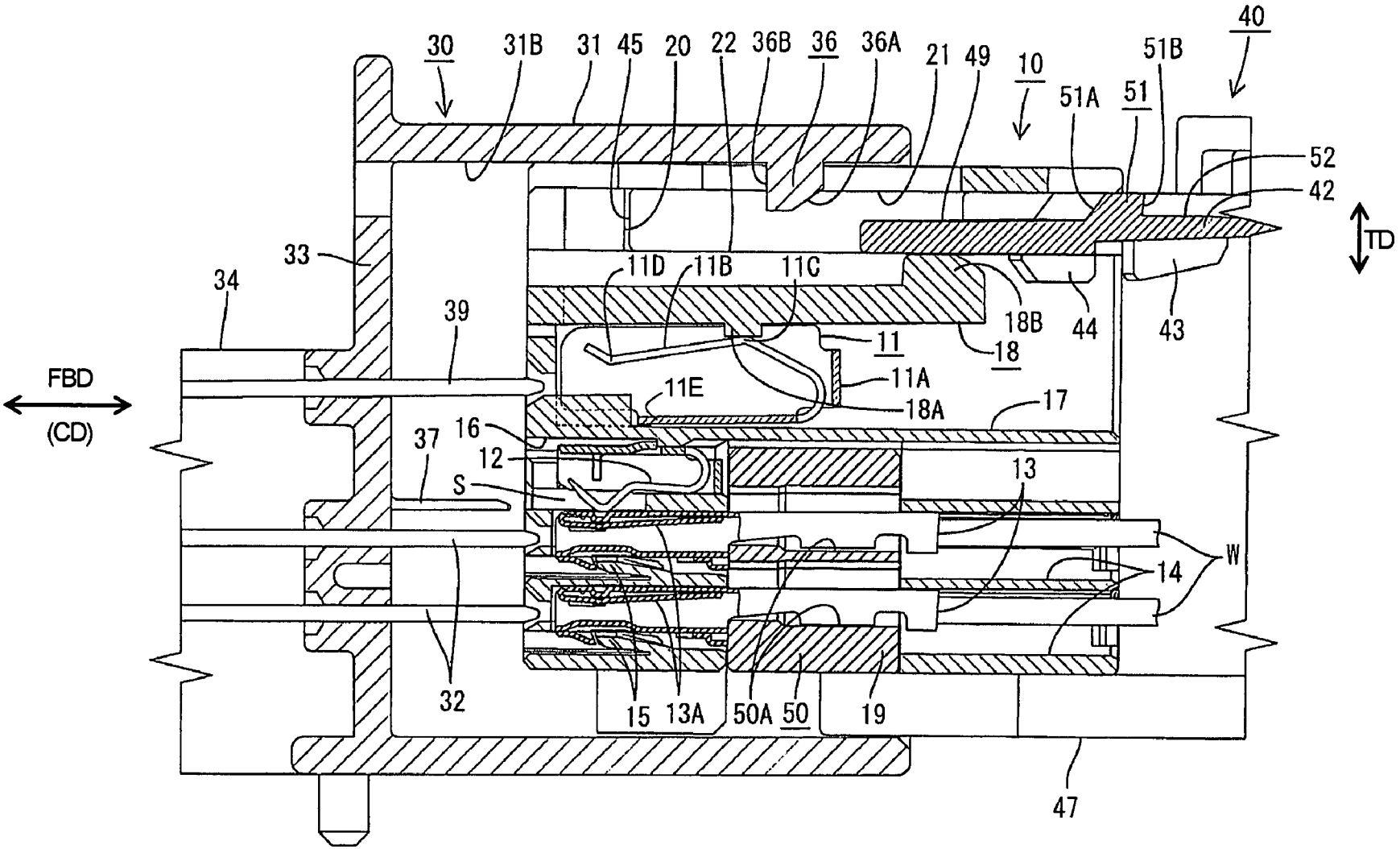
FIG. 1 is a side view in section showing a state of two housings at the start of a connecting operation in one embodiment of the invention.
Figure 4:
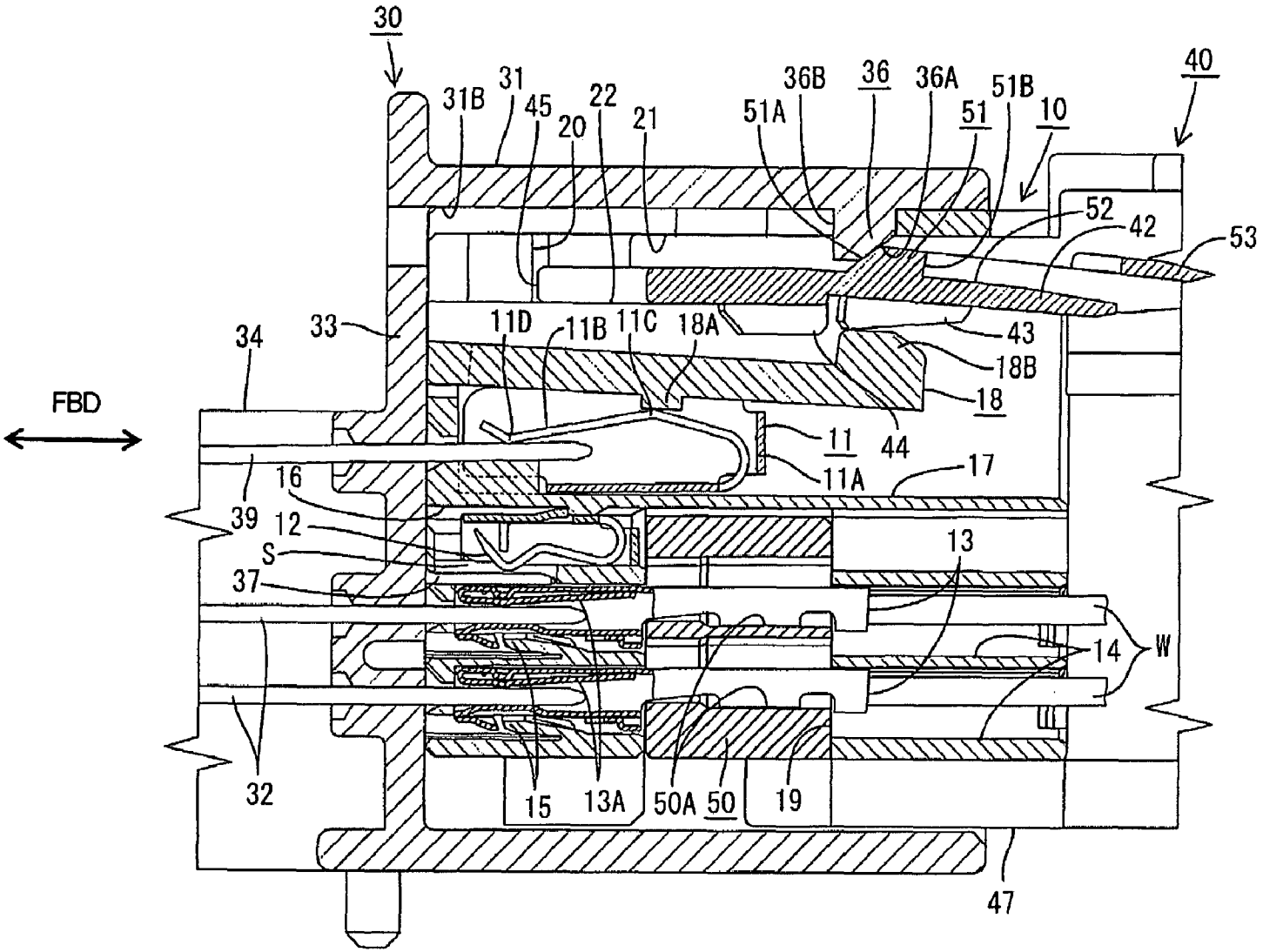
FIG. 4 is a side view in section showing a state where a pressing portion is located on a pressable portion.

A lock escaping recess 49 is formed in an area of the upper surface of the cam plate 45 before the locking piece 42 to avoid interference with the lock projection 36 during rotation of the lever 40. A locking projection 51 is near the base end of the locking piece 42 and is substantially continuous with the rear end of the lock escaping recess 49 to form a step that projects up and out. A guiding surface 51A slopes up and out toward the back at the front of the locking projection 51, as shown in FIG. 1, and the upper surface of the locking projection 51 is substantially flush with the outer surface of the cam plate 45. A substantially vertical locking surface 51B is at the rear of the locking projection 51, and a recess 52 is formed behind the locking surface 51B. Thus, the locking piece 42 deforms down and in when the guiding surface 51A of the locking projection 51 moves onto the guiding surface 36A of the lock projection 36. The locking piece 42 restores resiliently when the locking projection 51 moves over the lock projection 36 and the lever 40 reaches the connection ending position CEP. Thus, the lock projection 36 fits in the recess 52 and the locking surface 51B of the locking projection 51 engages the locking surface 36B of the lock projection 36. As a result, the lever 40 cannot rotate towards the standby position SBP and the two housings 10, 30 are held completely connected. An unlocking portion 53 bridges the recess 52 at the rear end of the locking piece 42, as shown in FIG. 4, and the locked state of the locking surface 36B of the lock projection 36 and the locking surface 51B of the locking projection 51 can be canceled by pressing the unlocking portion 53 down and in.

Figure 5:
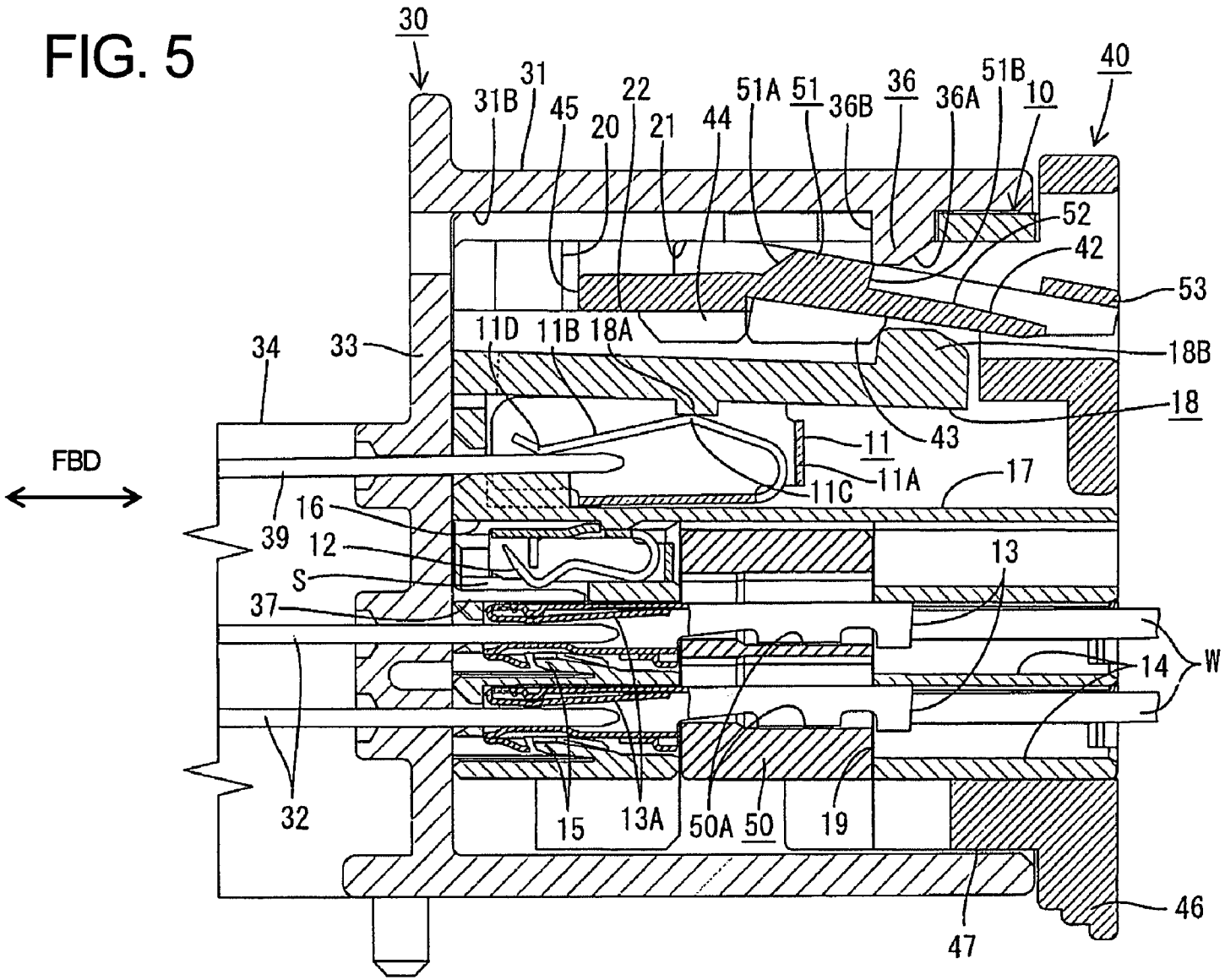
FIG. 5 is a side view in section showing a state reached when the pressing portion moves over the pressable portion.
Figure 6:
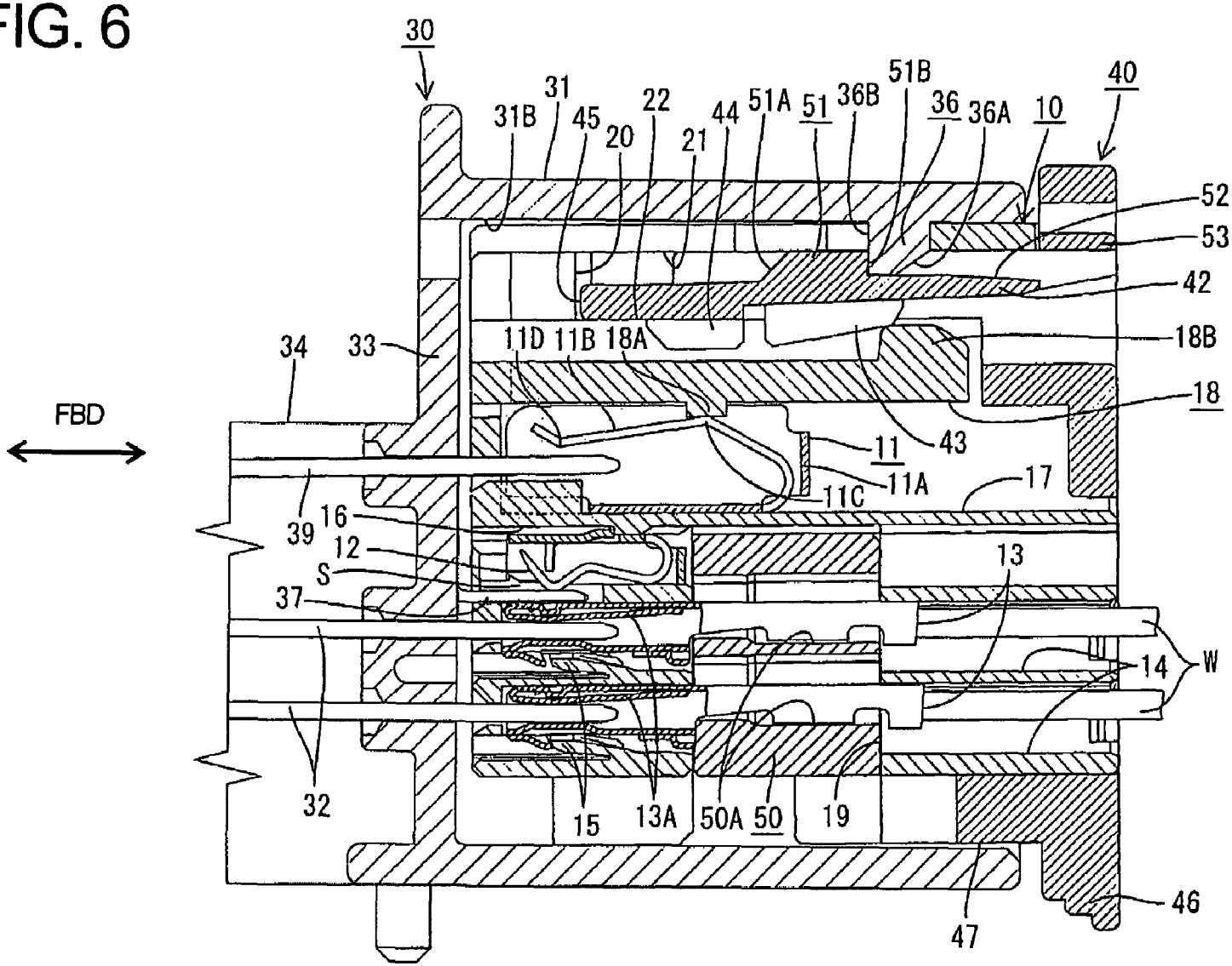
FIG. 6 is a side view in section showing a state where the connecting operation of the two housings is completed.

As shown in FIG. 6, a pressing portion 43 projects down in at a position of the lower surface of the cam plate 45 corresponding to the base end of the locking piece 42. The front surface of the pressing portion 43 is substantially vertical unless the locking piece 42 is deformed, and the lower surface thereof is inclined obliquely up and out toward the back from the bottom end of the front surface to the rear surface. The lower surface of the pressing portion 43 slides along a rotational path on the upper surface of a pressable portion 18B of the resilient arm 18 from behind, as shown in FIG. 4, with the locking piece 42 resiliently deformed. The inclination of the lower surface of the pressing portion 43 is set so that the resilient arm 18 can be held in a specified deformed posture during this time. The resilient arm 18 is restored when the pressing portion 43 moves over the pressable portion 18B. However, the pressing portion 43 and the pressable portion 18B are held in contact with the resilient arm 18 held in the specified deformed posture shown in FIG. 5. The first and second detecting terminals still are kept in contact with the resilient arm 18 restored.

A pre-pressing portion 44 projects down and in at a position on the inner surface of the cam plate 45 corresponding to the lock escaping portion 49, as shown in FIG. 5. The pre-pressing portion 44 is arranged to move along the same rotational path as the pressing portion 43 during the rotation of the lever 40. The front surface of the pre-pressing portion 44 slopes down and in toward the back, the lower and inner surface thereof is substantially horizontal and substantially parallel to the lower surface of the cam plate 45, and the rear surface thereof is substantially vertical. A distance between the pre-pressing portion 44 and the pressing portion 43 is less than a dimension of the pressable portion 18B of the resilient arm 18 in forward and backward directions FBD to prevent the pressable portion 18B from entering between the pressing portion 43 and the pre-pressing portion 44. The pre-pressing portion 44 slides from the inclined surface of the pressable portion 18B onto the upper surface of the pressable portion 18B along the rotational path from behind before the pressing portion 43 presses the pressable portion 18B along the rotational path during the rotation of the lever 40. Thus, the resilient arm 18 deforms down and in. When the lever 40 is moved further, the pressable portion 18B moves from the pre-pressing portion 44 to the pressing portion 43.

Two first housings 10 are provided and correspond respectively to the two fitting recesses 31B. As shown in FIG. 1, the lever 40 and a retainer 50 are assembled into each first housing 10. The first housing 10 shown in FIGS. 7 to 12 is the one to be accommodated in fitting recess 31B of the second housing 30, and has a substantially transversely symmetrical shape with the housing that is to be accommodated into the other fitting recess 31B. The latter first housing 10 is not described below.

The first housing 10 is made e.g. of a synthetic resin and is substantially in the form of a block. Cavities 14 penetrate the first housing 10 in forward and backward directions FBD and are arranged at upper, middle and lower stages in positions corresponding to the second terminal fittings 32 when the housings 10, 30 are connected. The first terminal fittings 13 connected with ends of wires W are insertable into the cavities 14 from behind. A lock 15 projects from an inner surface of each cavity 14 and engages the properly inserted first terminal fitting 13 to prevent the first terminal fitting 13 from coming out backward. The second terminal fittings 32 enter the first terminal fittings 13 as the housings 10, 30 are connected, and contact resilient contact pieces 13A folded back into the first terminal fittings 13 from the front edges of the upper surfaces of the first terminal fittings 13. Thus, the terminal fittings 13, 32 are connected electrically.

Detecting terminal accommodating portions 17 penetrate the first housing 10 in forward and backward directions FBD at positions corresponding to the second detecting terminals 39 when the housings 10, 30 are connected. The detecting terminal accommodating portions 17 are transversely juxtaposed with the cavities 14 at the upper stage, and the first detecting terminals 11 are insertable therein from behind. The first detecting terminals 11 connect electrically with the respective second detecting terminals 39 of the second housing 30 as the two housings 10, 30 are connected, to close the connection detecting circuit for detecting the connected state of the two housings 10, 30.

A retainer mount hole 19 is formed in the bottom surface of the first housing 10 for receiving the retainer 50. The retainer mount hole 19 laterally crosses the respective cavities 14 at the three stages, except the detecting terminal accommodating portions 17. Terminal insertion holes 50A penetrate the retainer 50 in forward and backward directions FBD at positions corresponding to the respective cavities 14. The retainer 50 is movable between a partial locking position where the first terminal fittings 13 can be inserted and withdrawn through the terminal insertion holes 50A and a full locking position where front ends of the bottom surfaces of the terminal insertion holes 50A engage the rear ends of the first terminal fittings 13 and prevent the first terminal fittings 13 from coming out backward.

The accommodating space 20 is formed at an upper part of the first housing 10 between a covering wall 21 constituting the upper surface of the first housing 10 and a lever mounting surface 22 facing the inner surface of the covering wall 21. The accommodating space 20 has an open rear side and the lever 40 is slid into the accommodating space 20 from behind while being held in a horizontal posture. The accommodating space 20 communicates with the insides of the detecting terminal accommodating portions 17, and the resilient arm 18 is in this communicating part.

The resilient arm 18 is in long in forward and backward directions FBD and has a substantially horizontal posture. A contact projection 18A projects down and in from substantially the center of the lower surface of the resilient arm 18 with respect to forward and backward directions FBD. The pressable portion 18B projects up in a direction opposite the contact portion 18A at the free rear end of the upper surface of the resilient arm 18. The resilient arm 18 is formed by two slits that extend forward from the rear end of a wall between the accommodating space 20 and the detecting terminal accommodating portions 17 and by making an area between the slits deformable up and down relative to the front end. The first detecting terminals 11 are accommodated in the detecting terminal accommodating portions 17 and thus can be protected without being exposed to the outside.

The pressable portion 18B projects up from the rear end of the resilient arm 18, and a rear side of the upper surface thereof slopes down and in towards the back. The pre-pressing portion 44 and the pressing portion 43 of the lever 40 slide in contact with the pressable portion 18B along an arcuate rotational path of the lever 40 as the lever 40 is rotated. Thus, the resilient arm 18 is deformed down and in. At this time, the lever principle is utilized upon pressing the pressable portion 18B, so that an operating force needed to deform the resilient arm 18 is reduced.

The bearing portion 22A projects up and out from the lever mounting surface 22 for rotatably supporting the lever 40. The cam plate 45 of the lever 40 moves over the bearing 22A in the process of mounting the lever 40 and widens the accommodating space 20 by resiliently deforming the covering wall 21 up and out. The bearing 22A then fits into the bearing hole 45A of the cam plate 45 when the lever 40 reaches a proper mount position. Thus, the cam plate 45 is supported rotatably and retained in the accommodating space 20. The bearing 22A and the cam pin 35 are aligned substantially on the same straight line along the connecting directions CD of the two housings 10, 30 when the housings 10, 30 are connected. On the other hand, an unillustrated bearing projects down at a position on the bottom surface of the first housing 10 substantially coaxial with the bearing 22A in vertical direction. This bearing portion 22A is fit into an unillustrated bearing hole in the inner surface of the posture correcting arm 47 to support the posture correcting arm 47 rotatably.

Shorting-terminal accommodating portions 16 penetrate the first housing 10 in forward and backward directions FBD above respective pairs of cavities 14 adjacent to each other along the width direction at the upper and middle stages and receive the shorting terminals 12. Each shorting-terminal accommodating portion 16 communicates with the insides of both cavities 14 adjacent thereto, and this communication space S opens in the front surface of the first housing 10.

Figure 2:
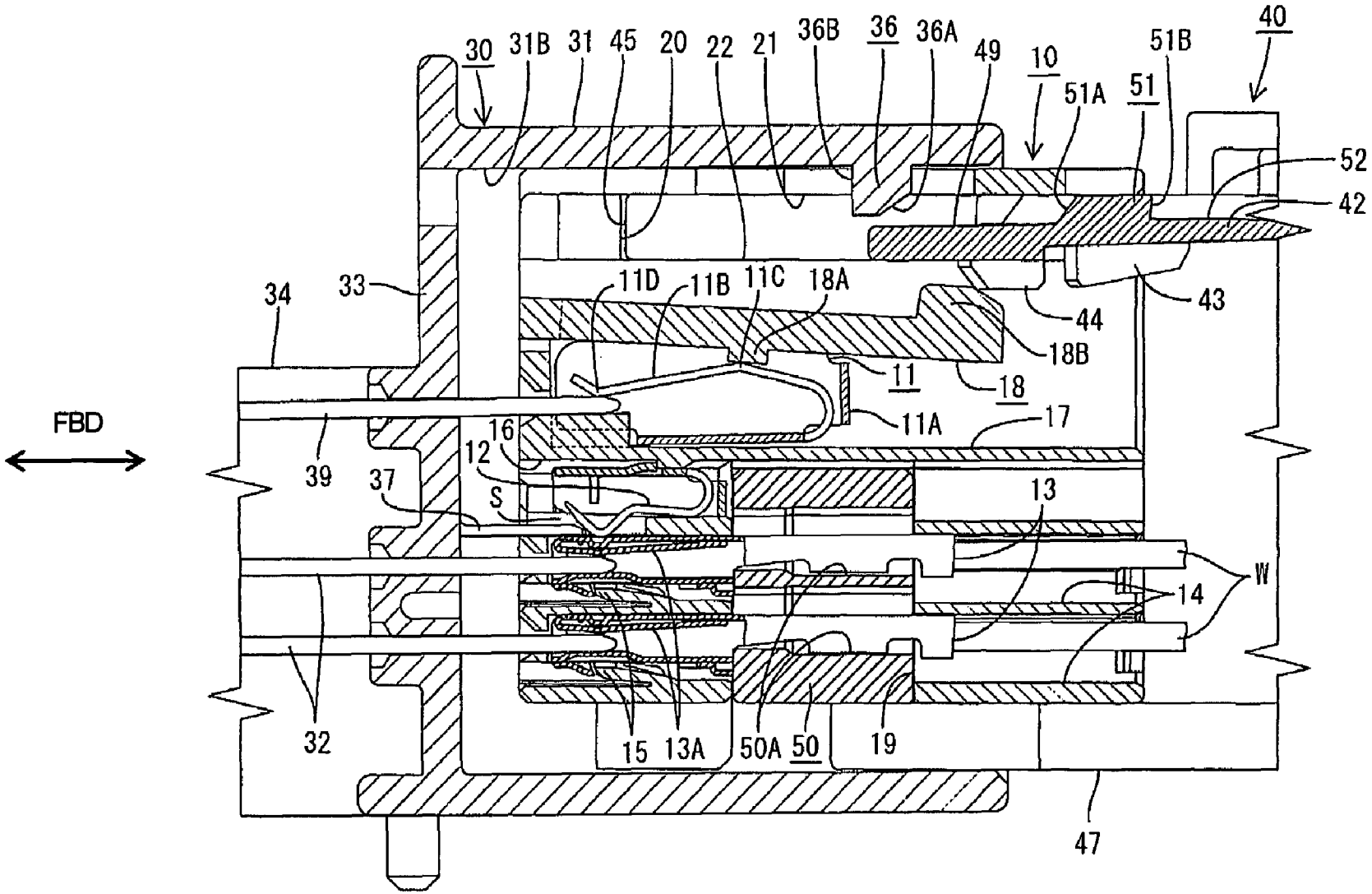
FIG. 2 is a side view in section showing a state where first detecting terminals and second detecting terminals start touching each other.
Figure 3:
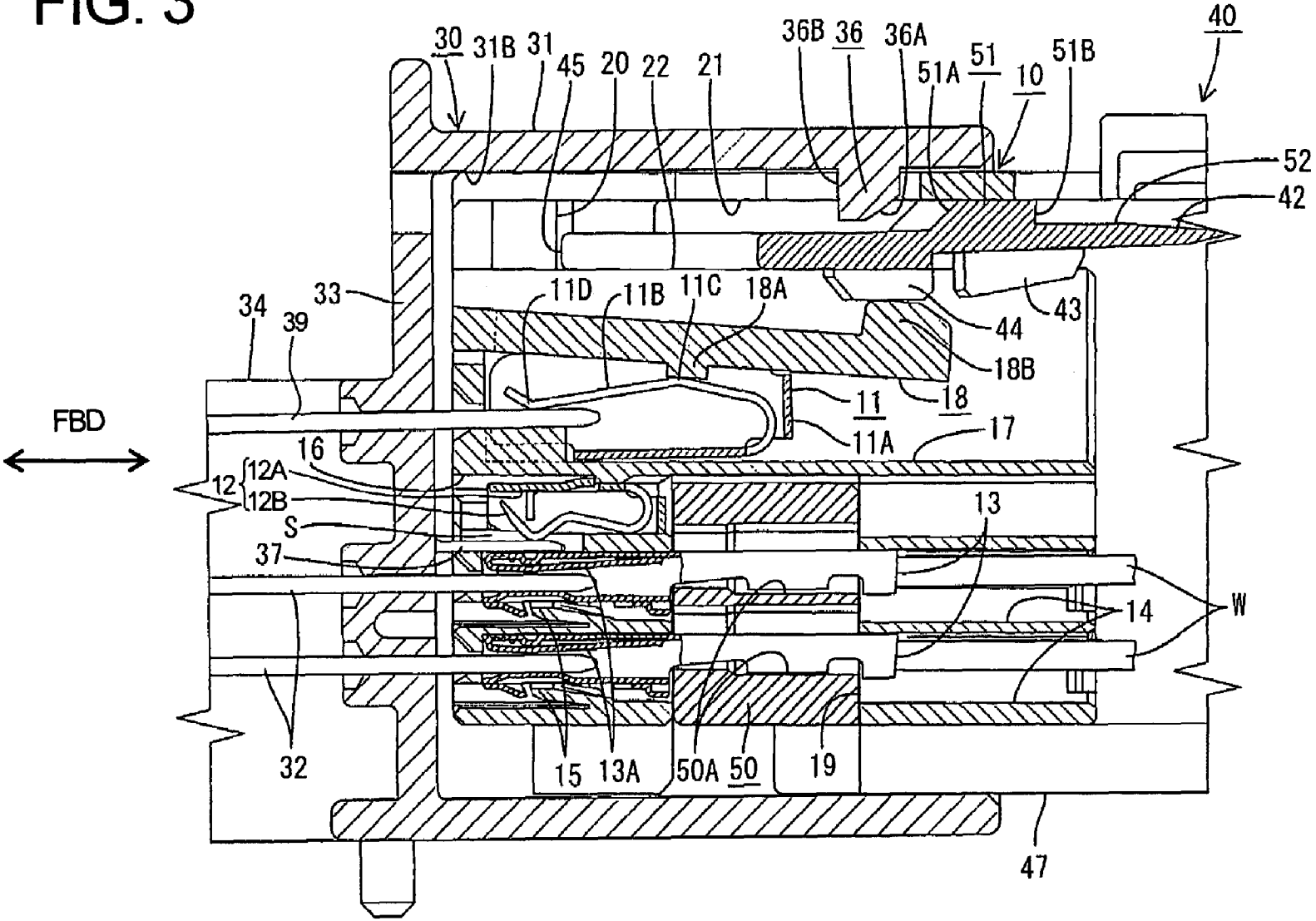
FIG. 3 is a side view in section showing a state where shorting circuits are open.

Each shorting terminal 12 has a main body 12A with a substantially U-shaped cross section defining an open bottom end. Resiliently deformable tongues 12B are folded back into the main body 12A from the rear edge of the upper surface of the main body 12A. The tongues 12B contact the bottom surface of the shorting-terminal accommodating portion 16, then incline up toward the front, then incline down to contact the first terminal fittings 13 through the communication space S, and consequently incline up again. Specifically, as shown in FIG. 2, the shorting terminal 12 resiliently touches one pair of adjacent first terminal fittings 13 through the communication space S, thereby closing a shorting circuit for shorting (electrically connecting) these two first terminal fittings 13. The short canceling members 37 of the second housing 30 enter the communication spaces S from the front while the two housings 10, 30 are being connected and thrust themselves between the shorting terminals 12 and the corresponding pairs of first terminal fittings 13, as shown in FIG. 3. Thus, the shorting circuits are held open in an electrically unconnected state. It should be noted that the shorting circuits are set to open after the first and second terminal fittings 13, 32 are connected electrically for the safety assurance of the operation.

Each first detecting terminal 11 is formed by bending an electrically conductive metal plate into a specified shape and has a main body 11A with a substantially U-shaped cross section having an open upper end. A resiliently deformable contact piece 11B is folded back at the rear edge of the bottom surface of the main body 11A and then extends forward in the main body 11A. The contact piece 11B is substantially mountain-shaped, and a first contact point 11C is formed at the tip thereof. The first contact point 11C normally is held in contact with the contact projection 18A of the resilient arm 18. An extending end of the contact piece 11B is bent slightly up, and a second contact point 11D is at the lower side of this bend. The first contact point 11C is displaced down towards the leg 11E of the first detecting terminal 11 and deforms contact piece 11B for keeping the second contact point 11D in contact with the second detecting terminal 39. Thus, as shown in FIG. 2, the pre-pressing portion 44 and the pressing portion 43 contact the pressable portion 18B to deform the resilient arm 18 down and in as the lever 40 is rotated. The downwardly displaced contact projection 18A displaces the first contact points 11C of the first detecting terminals 11 down and thus deforms the contact pieces 11B down towards the leg 11E of the first detecting terminal 11. The downward deformation of the contact pieces 11B displace the second contact points 11D down towards the other leg 11E of the first detecting terminal 11 and into contact the second detecting terminals 39. In this way, the first and second detecting terminals 11, 39 are connected electrically to close the connection detecting circuit and to achieve an electrically connected state. The first detecting terminals 11 continue to touch the second detecting terminals 39 while the lever 40 is rotated and until the connecting operation of the two housings 10, 30 is completed. However, the first detecting terminals 11 are separated from the second detecting terminals 39 to hold the connection detecting circuit open in an electrically unconnected state when the connecting operation of the housings 10, 30 is completed.

Figure 13:
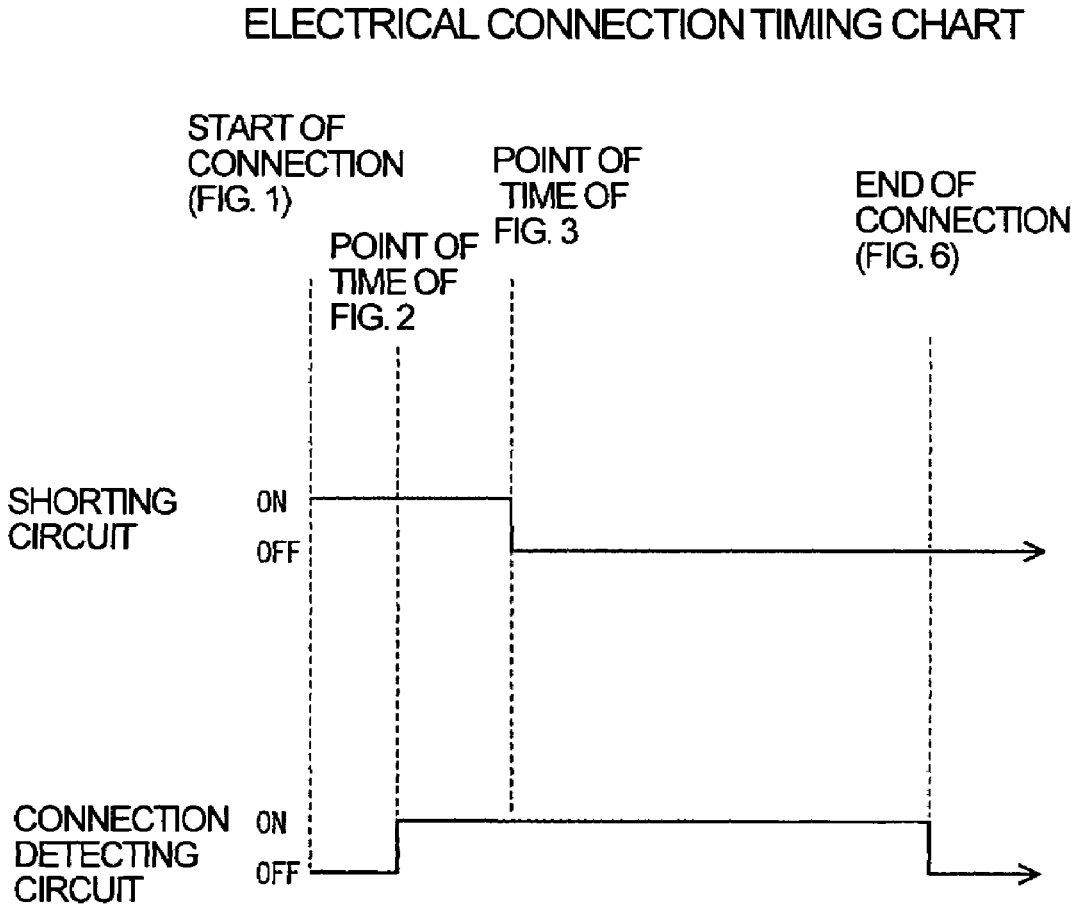
FIG. 13 is a timing chart showing a correlation between the connected state of the two housings and electrically connected states.

FIG. 13 is a timing chart showing a correlation between the electrically connected states of the shorting circuits and the connection detecting circuit and the connected state of the two housings 10, 30. As described above, when the connecting operation of the two housings 10, 30 is started (state shown in FIG. 1), the shorting circuits are connected electrically (ON-state) and the connection detecting circuit is unconnected electrically (OFF-state). The connection detecting circuit is connected electrically at a point of time shown in FIG. 2; the shorting circuits are unconnected electrically at a point of time shown in FIG. 3; and the detection connecting circuit is unconnected electrically when the connecting operation is completed (state shown in FIG. 6). In other words, according to an adopted controlling method, either the shorting circuits or the connection detecting circuit is connected electrically during the connecting operation of the two housings 10, 30, and both the shorting circuits and the connection detecting circuit are unconnected electrically when the connecting operation is completed.

The first housing 10 is fit lightly into the fitting recess 31B to cause the cam pin 35 to enter the cam groove 41, as shown in FIG. 7. The operable portion 46 of the lever 40 is rotated clockwise in this state. As a result, the cam action resulting from the engagement of the cam groove 41 and the cam pin 35 pulls the first housing 10 towards the second housing 30.

the pre-pressing portion 44 contacts the pressable portion 18B at the initial stage of the rotation of the lever 40 and deforms the resilient arm 18 down. As a result, the contact projection 18A is displaced down and displaces the first contact points 11C of the first detecting terminals 11 down, as shown in FIG. 2. The downward deformation of the first contact points 11C displace the second contact points 11D down. Substantially in parallel with this, the leading ends of the second detecting terminals 39 come to positions below the first contact points 11C. Thus, the second contact points 11D of the first detecting terminals 11 and the leading ends of the second detecting terminals 39 touch each other and connect electrically. As a result, the connection detecting circuit is closed. Simultaneously, the resilient contact pieces 13A of the first terminal fittings 13 contact the second terminal fittings 32 to connect the first terminal fittings 13 and the second terminal fittings 32 electrically.

Figure 9:
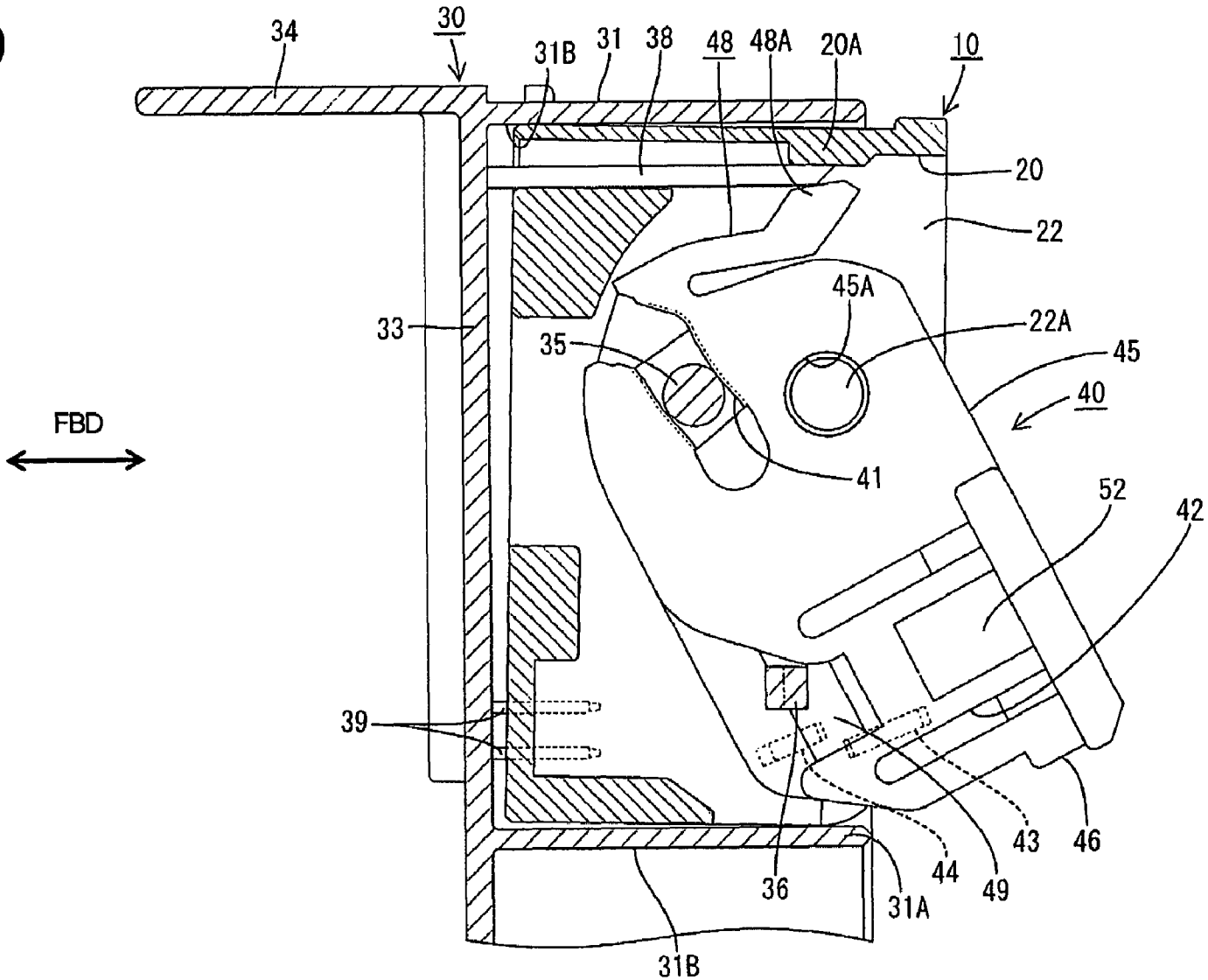
FIG. 9 is a plan view in section showing the state of FIG. 3.
Figure 10:
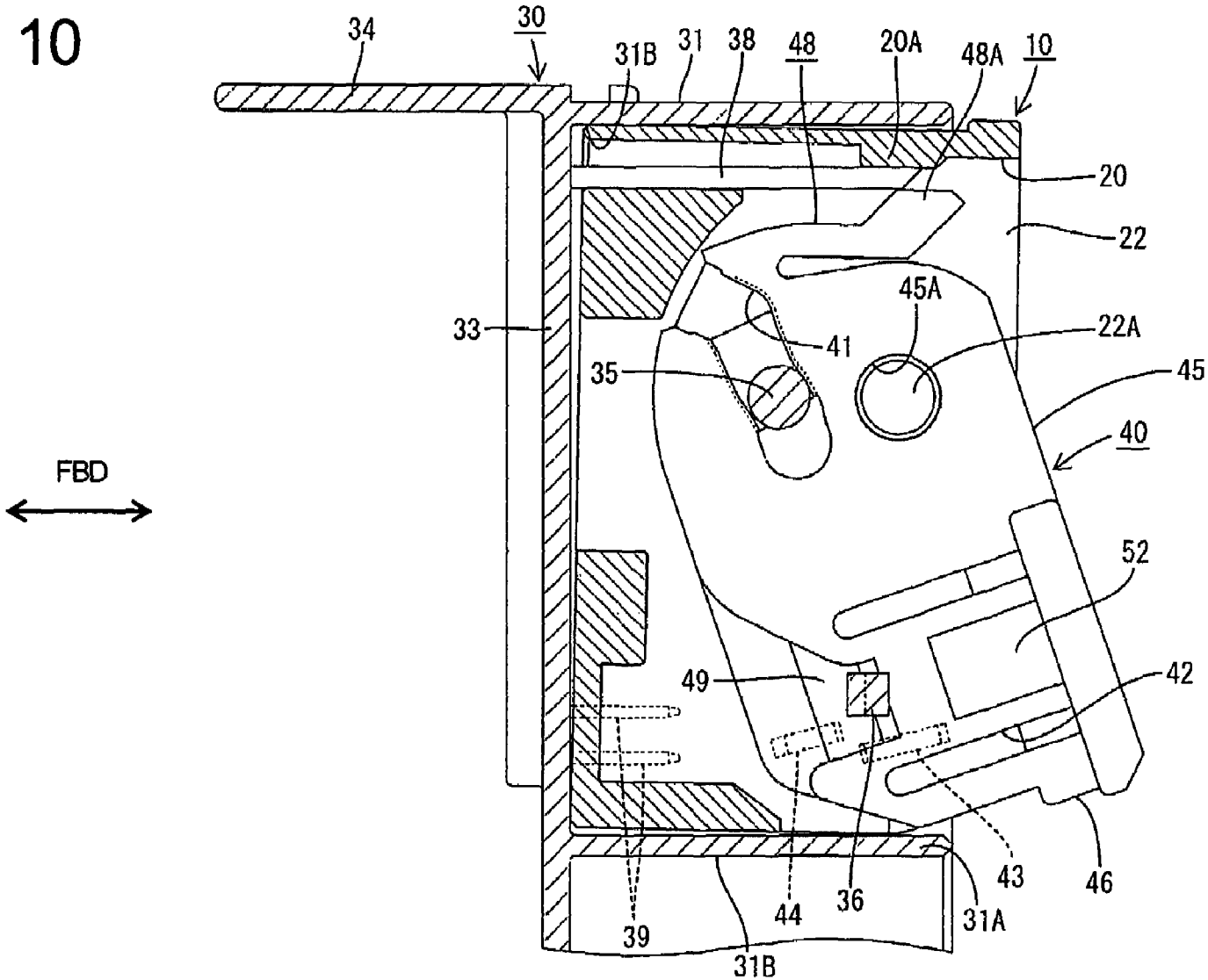
FIG. 10 is a plan view in section showing the state of FIG. 4.
Figure 11:
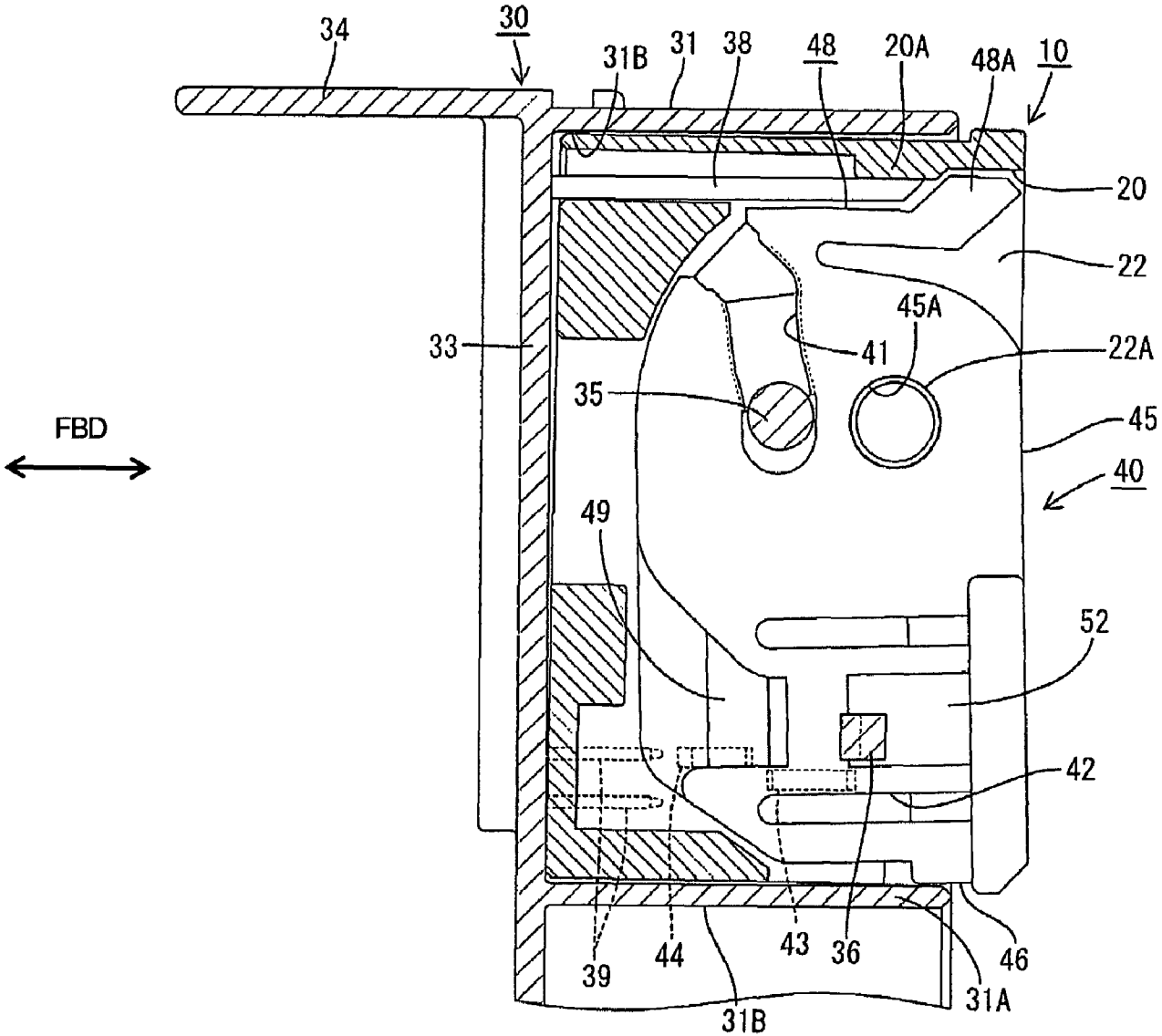
FIG. 11 is a plan view in section showing the state of FIG. 5.
Figure 12:
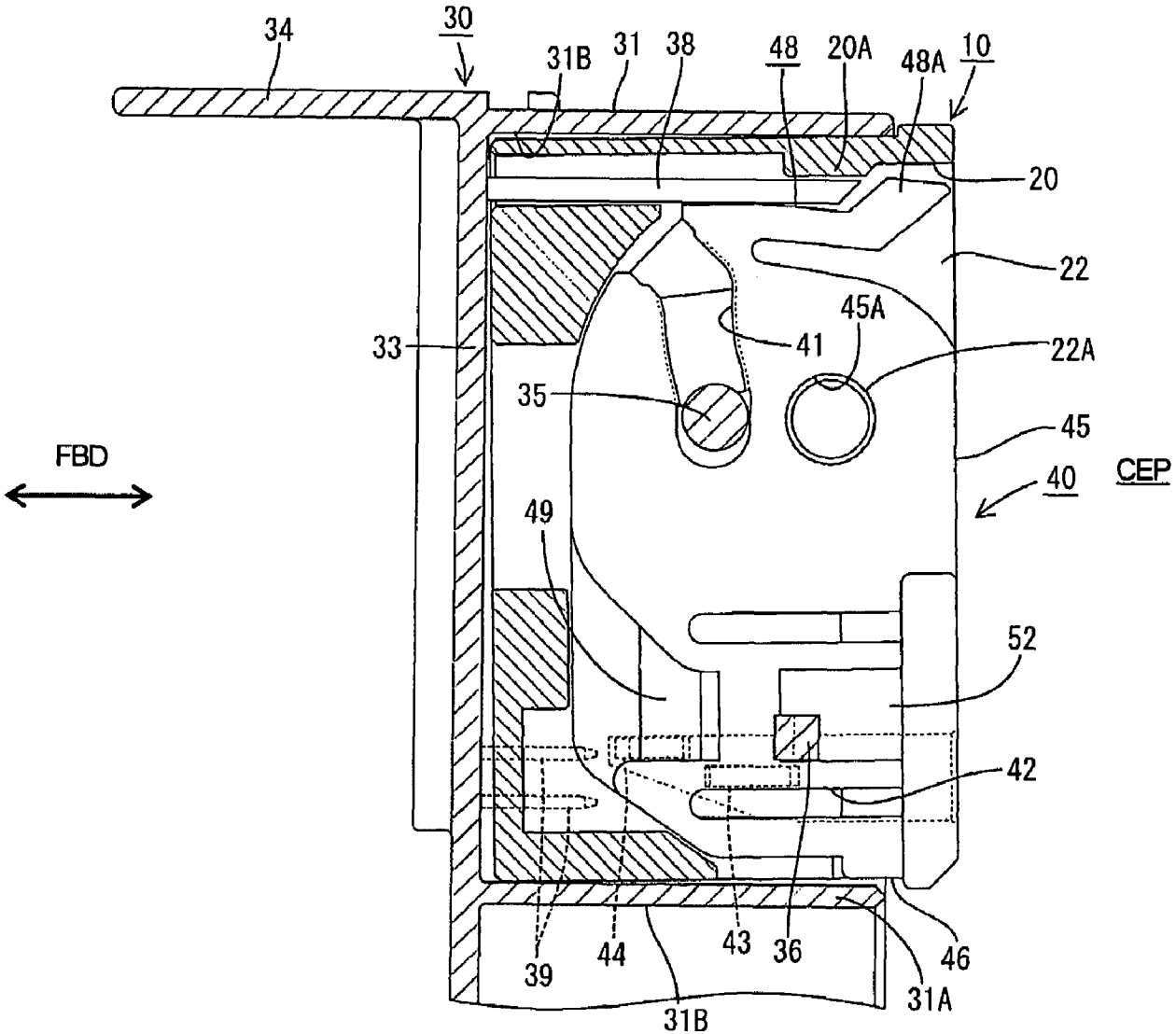
FIG. 12 is a plan view in section showing the state of FIG. 6.

The lower surface of the pre-pressing portion 44 slides on the upper surface of the pressable portion 18B as the lever 40 is rotated and the second detecting terminals 39 slidably contact the second contact points 11D of the first detecting terminals 11, as shown in FIG. 3. On the other hand, the short canceling members 37 of the second housing 30 are inserted from the front into the communication spaces S and thrust themselves between the shorting terminals 12 and the first terminal fittings 13. Thus, the electrical connection is cut off to open the shorting circuits. In this way, the first and terminal fittings 13 and 32 are connected electrically when the shorting circuits are opened to assure the safe operation. It should be noted that the lock projection 36 of the second housing 30 enters the lock escaping portion 49 of the lever 40 as shown in FIG. 9 to avoid interference with the lever 40.

The guiding surface 36A of the lock projection 36 contacts the guiding surface 51A of the locking projection 51 of the locking piece 42 when the lever 40 is rotated further, as shown in FIG. 4. Thus, the locking piece 42 starts being deformed down. Substantially in parallel with this, the pressable portion 18B moves from the pre-pressing portion 44 to the pressing portion 43. However, the resilient arm 18 is kept in a specified resiliently deformed posture. The pressable portion 18B moves over the pressing portion 43 and the resilient arm 18 is restored resiliently, as shown in FIG. 5, when the lever 40 is rotated to a position immediately before the connection ending position CEP. In this restored posture, the second contact points 11D of the first detecting terminals 11 still are kept in contact with the second detecting terminals 39. On the other hand, an angle of inclination of the locking piece 42 in the resiliently deformed posture is increased as the lever 40 is rotated further, and the locking piece 42 still is kept on the contact projection 18A even immediately before the locking projection 51 moves over the lock projection 36.

The locking projection 51 has already moved over the lock projection 36 when the lever 40 is at the connection ending position CEP. Thus, the locking piece 42 has been restored resiliently to fit the lock projection 36 into the recess 52, and the locking surface 51B of the locking projection 51 and the locking surface 36B of the lock projection 36 have engaged each other to lock the two housings 10, 30 in their completely connected state. Substantially in parallel with this, the resilient arm 18 is restored to displace the contact projection 18A upward. Thus, the first contact points 11C of the first detecting terminals 11 are displaced up, and the second contact points 11D are displaced up and away from the second detecting terminals 39 to open the connection detecting circuit. The completely connected state of the two housings 10, 30 can be detected by the opening of the connection detecting circuit.

As described above, the first detecting terminals 11 of the first housing 10 are in contact with the second detecting terminals 39 of the second housing 30 until the connection of the two housings 10, 30 is completed and the first detecting terminals 11 are separated from the second detecting terminals 39 when the connecting operation is completed. Thus, the connected state of the two housings 10, 30 can be detected electrically. Either the shorting circuits or the connection detecting circuit is kept electrically connected from the start of the connecting operation to the end of the connecting operation, and both circuits are opened upon completing the connecting operation, as shown in FIG. 13. This method is adopted for the following reasons. The connecting operation is surely in process even if noise is mixed in or present during the connecting operation, because the electrically connected state is already set. Thus, there is no likelihood of erroneously judging the completion of the connecting operation. In addition, even if noise is mixed in after the completion of the connecting operation, such noise mixture would be detected as an incompletely connected state and an abnormal state can be dealt with. Further, the shorting terminals 12 are separated from the first terminal fittings 13 after the first and second terminal fittings 13, 32 contact each other. Thus, the first terminal fittings 13 are connected electrically with the second terminal fittings 32 when freed from the shorted state and, accordingly, the safety of the operation can be assured. Furthermore, the first detecting terminals 11 are accommodated in the detecting terminal accommodating portions 17 and the resilient arm 18 is formed by cutting part of the inner wall forming the detecting terminal accommodating portions 17. Thus, the first detecting terminals 11 are protected and are not exposed to the outside. Further, the first detecting terminals 11 are deformed resiliently utilizing the lever principle by providing the pressable portion 18B near the free end of the resilient arm 18 and providing the contact projection 18A in an intermediate position of the resilient arm 18, an operation force exerted upon pressing the pressable portion 18B can be reduced.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lever 40 is assembled into the first housing 10 in the foregoing embodiment. However, the lever 40 may be assembled into the second housing 30 according to the present invention.

The resilient arm 18 is deformed by rotating the lever 40 in the foregoing embodiment. However, it is sufficient for the resilient arm 18 to be deformable as the two housings 10, 30 are connected. For example, the resilient arm 18 may be deformed by the contact with the inner surface of the fitting recess 31B of the second housing 30.

Although the lever-type connector in which the two housings 10, 30 are connected by rotating the lever 40 is illustrated in the foregoing embodiment, the connector need not necessarily be a lever-type connector and may utilize a lock arm according to the present invention.

Furthermore, any other operable member displaying a cam action other than a rotatable or pivotable lever such as a slider movable along a substantially linear path can be used in connection with the invention.

What is claimed is:

1. A connector, comprising:

first and second housings (10, 30) connectable with each other;

second terminal fittings (32), at least one second detecting terminal (39) and a short canceling member (37) being arranged in the second housing (30), first terminal fittings (13) disposed at positions in the first housing (10) for contacting the second terminal fittings (32), at least one shorting terminal (12) for contacting and shorting at least two of the first terminal fittings (13), a resilient arm (18) that deformable as the first and second housings (10, 30) are connected, and at least one resilient first detecting terminal (11) that is deformable as the resilient arm (18) is deformed and touches the second detecting terminal (39) to detect the connected state of the first and second housings (10, 30); and the resilient arm (18) being held resiliently deformed and the first detecting terminal (11) being held in contact with the second detecting terminal (39) until a connecting operation is completed;

the shorting terminal (12) being held separated from the first terminal fitting (13) by means of the short canceling member (37) as the connecting operation progresses; and the resilient arm (18) being restored resiliently and the first detecting terminal (11) being separated from the second detecting terminal (39) when the connecting operation is completed.

2. The connector of claim 1, wherein the shorting terminal (12) is configured to move between the shorting terminal (12) and the first terminal fittings (13) as the connecting operation progresses.

3. The connector of claim 1, wherein the shorting terminal (12) is separated from the first terminal fittings (13) after the first and second terminal fittings (13, 32) contact each other.

4. The connector of claim 1, wherein a movable member (40) is provided movably on one of the housings (10, 30) and is operable to generate a cam action for connecting and separating the housings (10, 30).

5. The connector of claim 4, wherein the movable member (40) is formed with at least one cam means (41) and is assembled movably into the first housing (10) at a side of the resilient arm (18) opposite the first detecting terminal (11), and a mating cam means (35) being formed in the second housing (30) and being configured for cooperation with the cam means (41).

6. The connector of claim 5, wherein at least one pressing portion (43) is formed at a portion of the movable member (40) substantially facing the resilient arm (18), the pressing portion (43) being configured to press the resilient arm (18) for holding the resilient arm (18) deformed during operation of the movable member (40) while permitting the resilient arm (18) to restore resiliently when the connecting operation is substantially completed.

7. The connector of claim 6, wherein the resilient arm (18) is cantilevered along a connecting direction (CD) of the first and second housings (10, 30) by cutting part of an inner wall of the detecting terminal accommodating portion (17) for accommodating the first detecting terminal (11).

8. The connector claim 7, wherein a pressable portion (18B) is formed at a free end of the resilient arm (18) for contact with the pressing portion (43), and a contact projection (18A) is formed at an intermediate position of the resilient arm (18) for contact with the first detecting terminal (11).

9. A method of controlling the assembly of a connector comprising a first and a second housings (10, 30) connectable with each other, comprising:

contacting a shorting terminal (12) with at least two first terminal fittings (13) in the first housing prior to connecting the housings (10, 30);

moving the first and second housings (10, 30) towards a connected condition;

contacting a first detecting terminal (11) in the first housing (10) with a second detecting terminal (39) in the second housing (30) during a connecting operation;

separating the shorting terminal (12) from the first terminal fittings (13) when the first terminal fittings (13) contact second terminal fittings (32) in the second housing (30); and separating the first detecting terminal (11) from the second detecting terminal (39) when the connecting operation is complete to detect the connected state of the first and second housings (10, 30).

10. The method of claim 9, wherein the shorting terminal (12) is separated from the first terminal fittings (13) by moving a short canceling member (37) between the shorting terminal (12) and the first terminal fittings (13).

* * * * *